US005540432A

United States Patent [19]

Keller

[11] Patent Number: 5,540,432

[45] Date of Patent: Jul. 30, 1996

[54] GOLF TEE AND BALL SETTER

[76] Inventor: Richard D. Keller, 6416 Fourth Ave., Takoma Park, Md. 20912

[21] Appl. No.: 381,566

[22] Filed: Jan. 31, 1995

[51] Int. Cl.[6] ..... A63B 57/00

[52] U.S. Cl. ..... 473/386

[58] Field of Search ..... 273/32.5, 32, 33; 294/19.1, 19.2

[56] References Cited

U.S. PATENT DOCUMENTS

| | | | |
|---|---|---|---|
| 5,080,357 | 1/1992 | Wolf | 273/32.5 |
| 5,205,598 | 4/1993 | Miller | 294/19.2 |
| 5,330,178 | 7/1995 | Geishert | 273/32.5 |

*Primary Examiner*—Theatrice Brown
*Attorney, Agent, or Firm*—Arthur R. Eglington

[57] ABSTRACT

A portable device for non-stooping placement of golf balls and golf tees on site comprising an elongated tubular shaft with specially modified ends. The lower shaft end has a golf ball holding pincers and an adjacent dual tine, fork-like tee holding socket and tee retrieving device. The upper shaft end comprises a biased trigger mechanism cantilevered to actuate the upper end of an elongate solid rod disposed slideably within the shaft, and with the rod lower end adapted to carry a horizontal flange which reciprocates between the tee clamping position and a tee supporting position. The device is adapted for sequentially setting a tee in the desired ground and then placing the golf ball on the spotted tee while the golfer remains in a standing position throughout. More broadly, there is provided a dissimilar objects grasping and placement device having a hand gripping and actuating longitudinal first end and oppositely extended object grasping second end, which provides for alternate loading and placement of unlike objects such as driving tee and golf ball.

10 Claims, 4 Drawing Sheets

GOLF TEE AND BALL SETTER

FIELD OF THE INVENTION

This invention relates to a golfing aid, and more precisely to a device for comfortably implanting a golf tee and positioning a golf ball thereon.

BACKGROUND OF THE INVENTION

In time, some golf players develop an anatomical problem with the task of squatting and/or bending over to implant a golf tee in the turf and then to deftly place a golf ball thereon. Subsequently, a golfer may also have some physical discomfort in salvaging the used tee after stroking the ball. Lastly, such a player finds it stressful to lean over excessively in order to retrieve the ball from a cup. While many styles of devices have been patented in recent years, they all evince certain disadvantages, such as, inconvenience in storing the device after use, mechanical complexity of structure leading to excessive costs for a routine golfing tool, and a need for device lay down (bending over) before stroking, and then pick-up for possible tee retrieval. Accordingly, it is a principal object of the invention to provide a placement device for a player who is unable to, or is too discomforted by back problems, to engage in the usual squatting or bending over needed for tee implanting and golf ball placement.

Another object of the invention is to provide a device not much larger than a playing club or iron, which is handily manipulated and is easily moved from one spot to another on the course like any other playing club.

Still another object of the invention is to provide a placement device of few moving parts, capable of easy operation, and of long-term use due to its simplified construction.

Yet another object of the invention is to provide a portable device which employs full hand strength in using the tee itself as a ground-piercing member, especially for dealing with hard packed dirt, or frozen ground often seen on the tee.

A further object of the invention is to provide a golfing device which fulfills the clear needs for easy portability, light weight, facility in handling, and serves as a quick means for placement of both tee and ball, followed by the hand recovery of either, as may be needed.

Other objects, advantages and purposes of the device of this invention will appear or become evident from the following detailed description of the invention taken in conjunction with the accompanying drawing wherein:

SUMMARY OF THE INVENTION

The golfing device of this invention comprises an elongated tubular member having open upper and lower longitudinal ends, in which is placed an elongated solid rod (either circular or rectilinear in cross section) slidably mounted therein, with both of the longitudinal ends of the rod projecting somewhat from the ends of the tubular member. A hand grippable member is attached fixedly at the upper end of the tubular member so that one longitudinal end thereof which overlaps and encloses the projecting upper end of the rod member. A cantilever member is aligned axially within of the one lower longitudinal ends of the hand grippable member. It has a finger-engageable element along the distal surface of that longitudinal end; and the grippable member has at its other longitudinal end, an underside planar surface normally contacting the upper rod end; a spring means is located proximal to the intermediate the segment of the cantilever member, and serves to bias same to hold a non-displacing contact with the upper rod end.

The upper rod end itself has mounted thereon a second spring member, which is adapted to bias the elongate rod to move in a direction upwardly within the hand grippable member. The juxtaposition of the contacting cantilever member and of the upper rod member end are such that the rod will move reciprocally downward within the tubular member, if the finger engageable element is activated to move in its arcuate path of motion; a first flange-like element is affixed at one point on the lower section of the tubular member periphery and is adapted to rest a golf ball thereon via gravity, until the ball is pysically dislodged. A second flange-like member is affixed at an opposing point on the lowermost periphery of the tubular member, and provides the function of limiting the degree of shift of the elongate rod end upwardly under the bias of the second spring means. Lastly, a third flange-like element is located beneath and adjacent to the second flange element and is pinned to the lowermost rod end, also being provided with an inwardly oriented recess, sized to support the shank of a golf tee; the adjacent second and third flange elements are normally biased by the spring-loaded rod member in a releasable clamping juxtaposition, that can be opened by the digital activation of the finger engageable element. It is then is maintained spaced-apart by such digital bias, or by the insertion of the tee in the resting recess provided in the third flange mean.

DETAILED DESCRIPTION OF A PREFERRED EMBODIMENT

Figure 1:
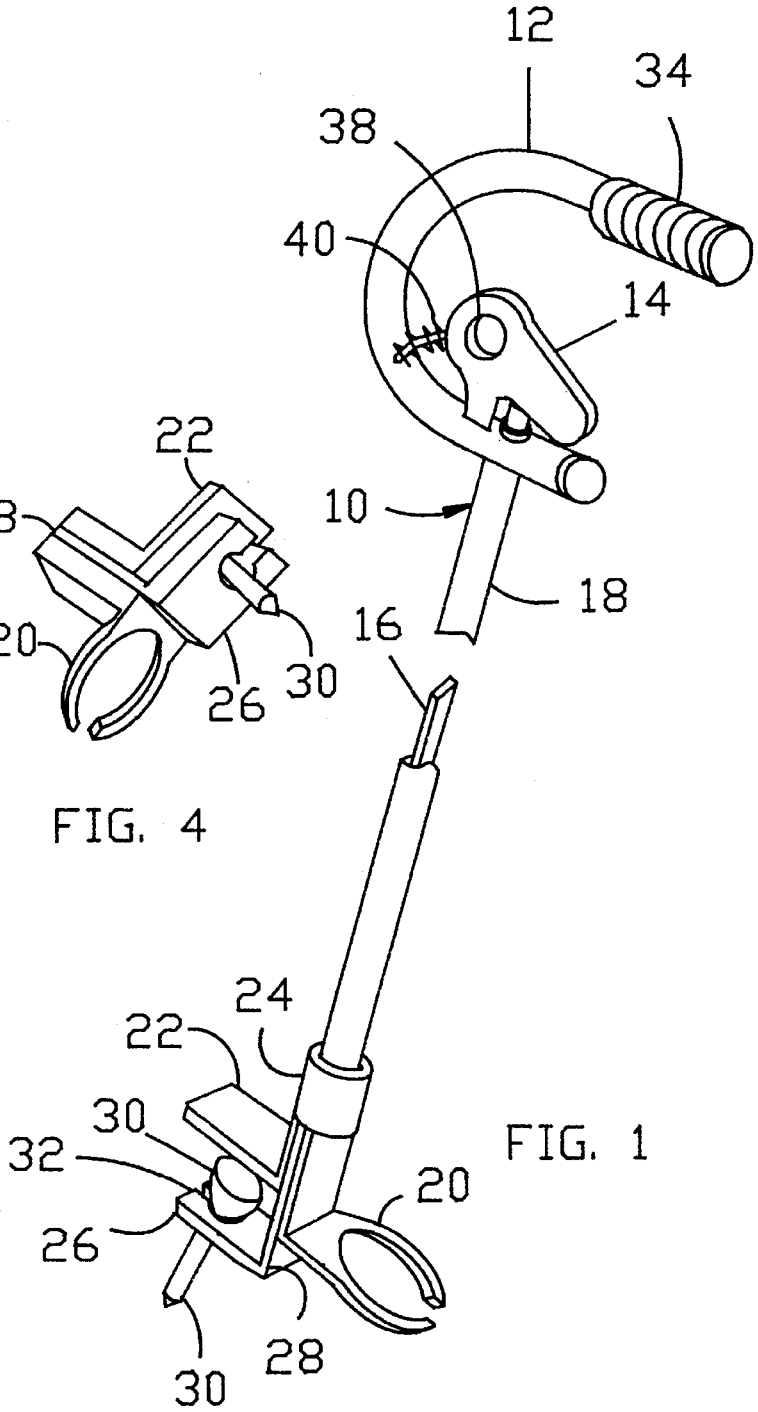
FIG. 1 is a perspective view of the assembled device with a gripping means activated to provide a gap at the device lower end, in which a golf tee has been positioned freely.

Referring now to the drawing and to FIG. 1 in particular, there is presented a perspective view of the recreational device of the present invention, in which like elements are identified using like numbers from figure to figure. The tee placement device 10 has several major components when assembled. A hand-grippable longitudinal end 12, preferably U-shaped; a finger-engageable cantilevered activation member 14; an elongate rigid rod 16; an elongate rigid tubular shaft 18 conveniently of a malleable metal, like aluminum containing the rigid rod; a lower end, outward flange 20 for golf ball nesting; an opposing side outward and upper flange 22 also fixedly secured to the lower periphery 24 of the shaft 18; and a similar form of lower flange 26, but which is fixedly secured to, the lower end of the elongate rod 16 itself, in a manner to be described. Flange 26 is seen as being offset, or spaced-apart, from rod-arrest flange 22.

Figure 2:
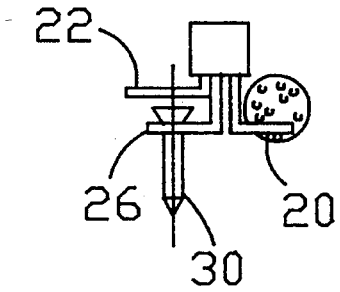
FIG. 2 is a schematic view of the broken away lower end of the device of FIG. 1 in which the tee is seen as located in an insertion mode along with a nested golf ball, readily available for mounting on a planted tee.

While the flanges 22 and 26 are shown in the spaced-apart mode of operation, a conventional golf tee 30 is slipped into the inward slot 32, provided in lower flange 26. When a golf ball 34 is nested in flange 20, the results are seen in the broken away elevational view of FIG. 2, In this mode, the tee can be inserted into or withdrawn from the ground, as the case may be. The alternate mode for tee and ball are as depicted in FIG. 3, when the tee is clamped within flanges 22 and 26 and is now adapted for turf insertion.

Figure 4:
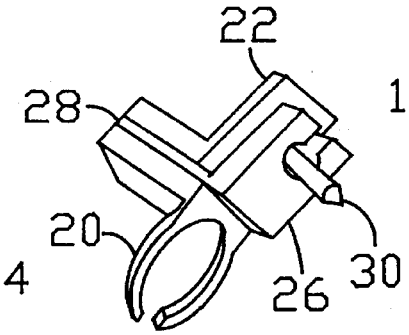
FIG. 4 is another broken away perspective view (underside) of the device operational end, corresponding to the clamp setting of FIG. 3, with a tee clamped ready for ground insertion.

A broken out, bottom perspective view of the clamped tee is seen in FIG. 4. The tee is more conveniently implanted omitting the ball.

Averting again to FIG. 1 particular, the uppermost arm of gripping means 12 is optionally provided with a resilient tubular gripping sleeve 34 to facilitate grasping during device carrying or manipulation. The upper longitudinal end 36 of rigid rod 16 (FIG. 3) projects, perhaps 0.5", from the upper end of tubular member 18, while the other lower longitudinal end 28 of rod 16 can displaced outwardly, presenting the transient temporary gap in the lower end flanges that permits tee insertion. The upper cantilever member 14 is oriented upwardly, and can be actuated rearwardly, so as to make depressive contact with the rod upper end 36, holding same in a depressed position so long as the flange gap for tee handling is to be maintained. Member 14 has a finger-engageable aperture 38 in its uppermost segment.

Figure 3:
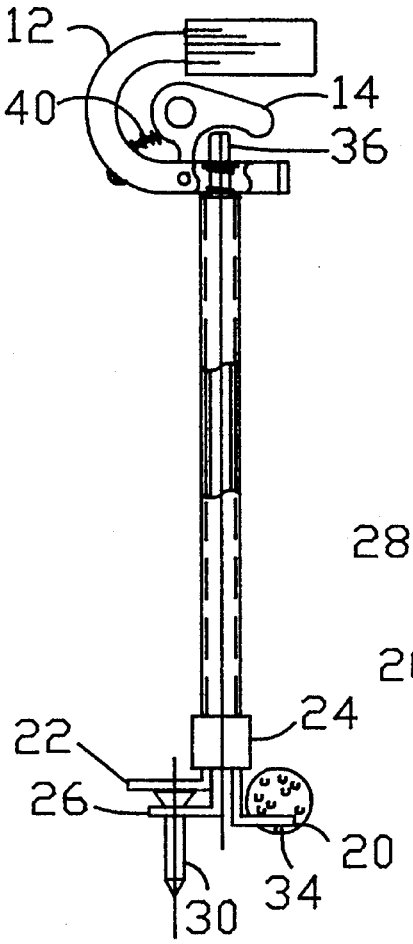
FIG. 3 is a schematic elevation of the entire device with a tee clamped and ready for ground insertion and of the companion golf ball for mounting thereon and also with a broken away portion showing the actuating upper end of the device depicting the linked elements that activate the reciprocal movement of the upper end of an elongate rod.

In the elevational view of FIG. 3, a bendable spring element 40 is seen mounted radially of the body of handle 12 which projects inwardly, with its free tip contacting the outer periphery of member 14, so as to make continuous contact with it. By use of this spring biasing, upper rod end 36 is immediately axially responsive to any rearward rotational movement exerted upon the cantilever member 14; such movement is started by exerting a digital force (not seen) on its finger port 38, provided in the opposing planar faces of the member 14.

Figure 6:
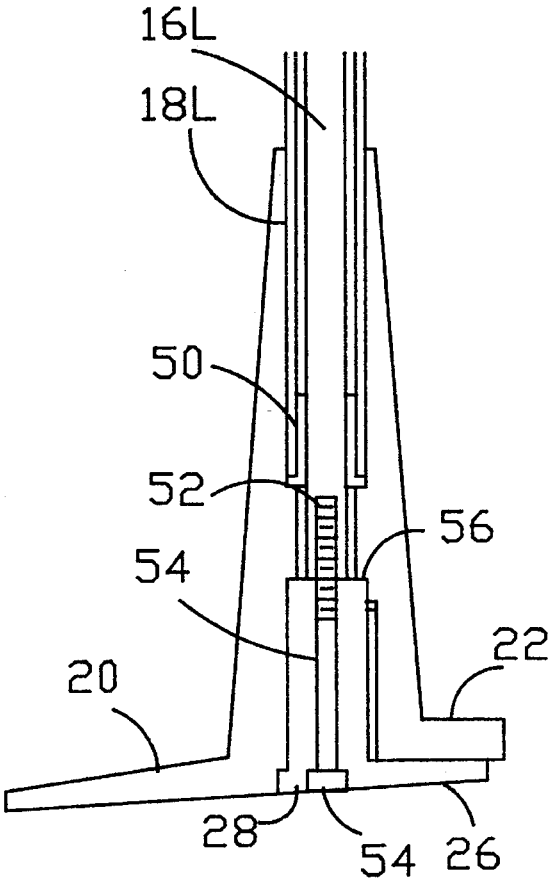
FIG. 6 is a broken away, sectional view of the operational end of the golfing device, in the rest mode, with lower end flanges clamped shut.
Figure 7:
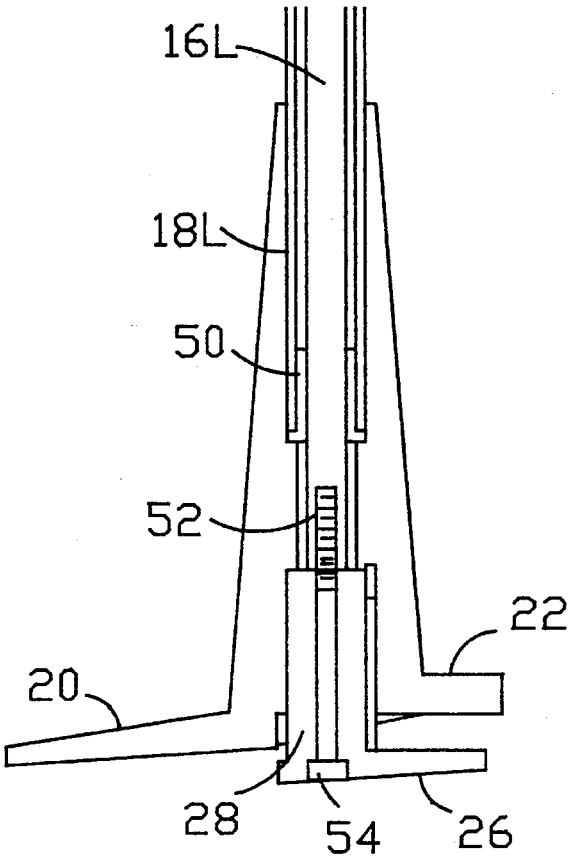
FIG. 7 is the sectional view of the operational end but in the active mode with lower end flanges apart and adapted to secure a tee.
Figure 5:
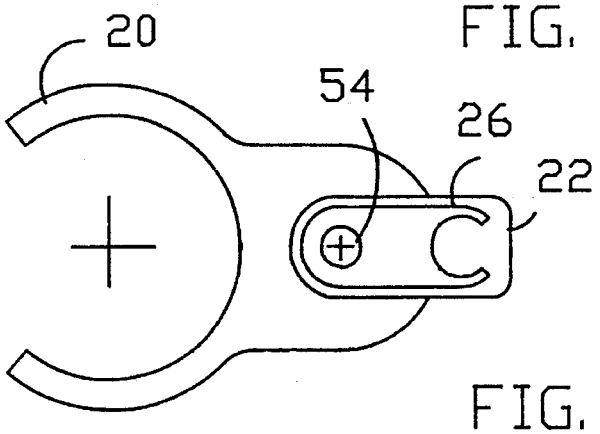
FIG. 5 is a schematic bottom view of the operating end of such device depicting the ball nesting flange and on the opposing side a pair of tee nesting and clamping flanges, without a tee in place.

Looking now to the broken away, sectional view of the lower operational end of the golfing device, this is set out in FIGS. 6 and 7. The lower segment 18L of tubular member, and its enclosed, elongate rod 16L, are similarly kept aligned by a lower end bushing 50. The lowermost end of the rod is axially counterbored 52 and tapped to receive the reciprocating flanged member 28 in a fixed manner. An elongate, threaded machine bolt 54 pins member 28 to the elongate rod longitudinal end, at 56 whereby any movement of the rod 16L is tracked by the associated flange member 28 which, as described also carries the tee-nesting recess 32 in flange 26 of FIG. 1.

The orientation of tee-nesting flange 26 depicts how upper and opposing flange limits the degree of uplift of the control rod 16L, always under the spring-bias located at its upper rod end. Leftward oriented larger flange 20, as described, carries the ball-nesting recess of FIG. 1–5. In this mode, the tee-guiding flanges are clamped shut; while in the mode of FIG. 7, they have moved apart (by means of trigger activation) to present a transient gap that permits tee-insertion (not shown).

The foregoing detail should make evident the manner of loading of the central rod into the device. After the upper trigger-cantilever 14 is in its balanced position, and is operatively contacting rod upper end 36, the tee-nesting flange 26 is slipped into the tubular lower end to abut the lowermost periphery 56 of the tubular member. Mounting bolt 54 is affixed in a customary manner to pin the member 28, control rod 16L, and upward trigger means 14 into a fully operative stance.

Figure 8:
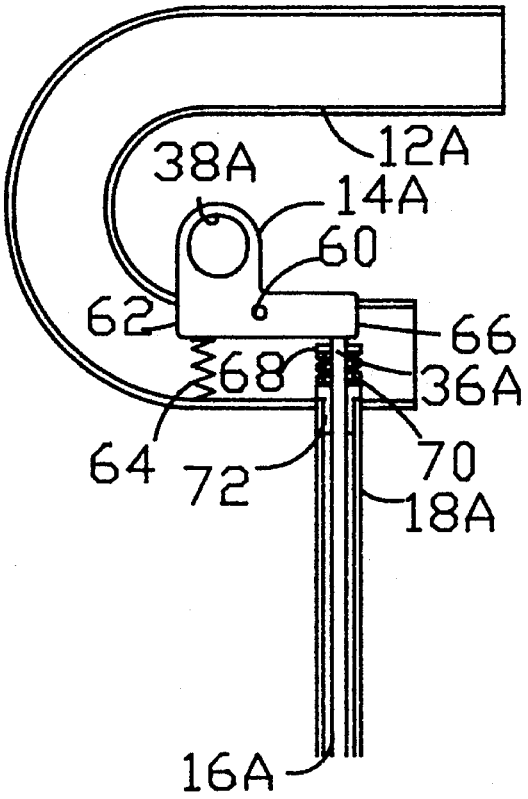
FIG. 8 is a schematic elevational view of the gripping means of an alternate embodiment of the invention with its trigger mechanism in the at rest (non-use) position.
Figure 9:
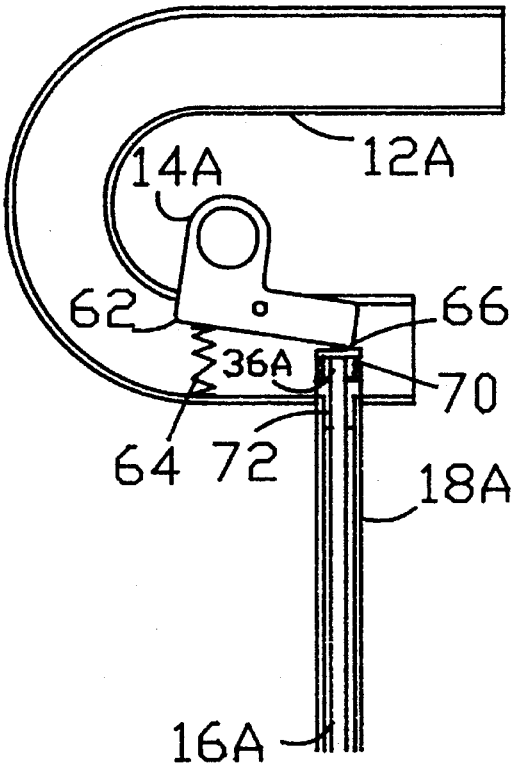
FIG. 9 is a like schematic view of the alternate embodiment of FIG. 8 but with its trigger mechanism in the activated (open flanges) position.

Averting now to FIGS. 8 and 9, there are depicted an alternate configuration for the control rod activation means, with FIG. 8 depicting same in the at-rest mode (no flange separation at the rod lower end), and FIG. 9 depicting the activated mode (flange separation during tee insertion and while a clamped tee is being held). U-shaped grippable means 12A is similarly provided with a triggering cantilever 14A of a somewhat dissimilar configuration for its activation. The lever 14A has a pivotable pin 60 located intermediate its opposing ends. The lever inward end 62 is supported on a light coiled spring 64, disposed within the hollow body of grippable means 12A. This upward bias maintains the outer lever end 66 in regular contact with the upper end 36A of elongate rod 16A, which has a fixed transverse pin 68 that limits expansion of the other coiled spring 70 (higher strength) mounted on the rod upper end. In the mode of FIG. 8, the laterally offset and opposing springs 64 and 70 are in balance, so long as no force is being exerted upon engageable aperture 38A of means 14A.

When a digital force (not seen) is exerted on the trigger means 14A, that component rotates partly clockwise, as seen in FIG. 9, compressing bushing-aligned, stronger spring 70, and pushing elongate rod 16A somewhat downwardly within tubular member 18A. The result at the lower device end is just as depicted FIGS. 1–3, permitting tee insertion and clamping. Note that solid rod 16A is centrally positioned at its upper end by bushing 72, the head 36A of which rod also provides the planar base on which coil spring 70 is placed and confined between it and pin 68. With the exception of the alternate triggering means just described, the balance of the device is operated in exactly the same manner.

Figure 10:
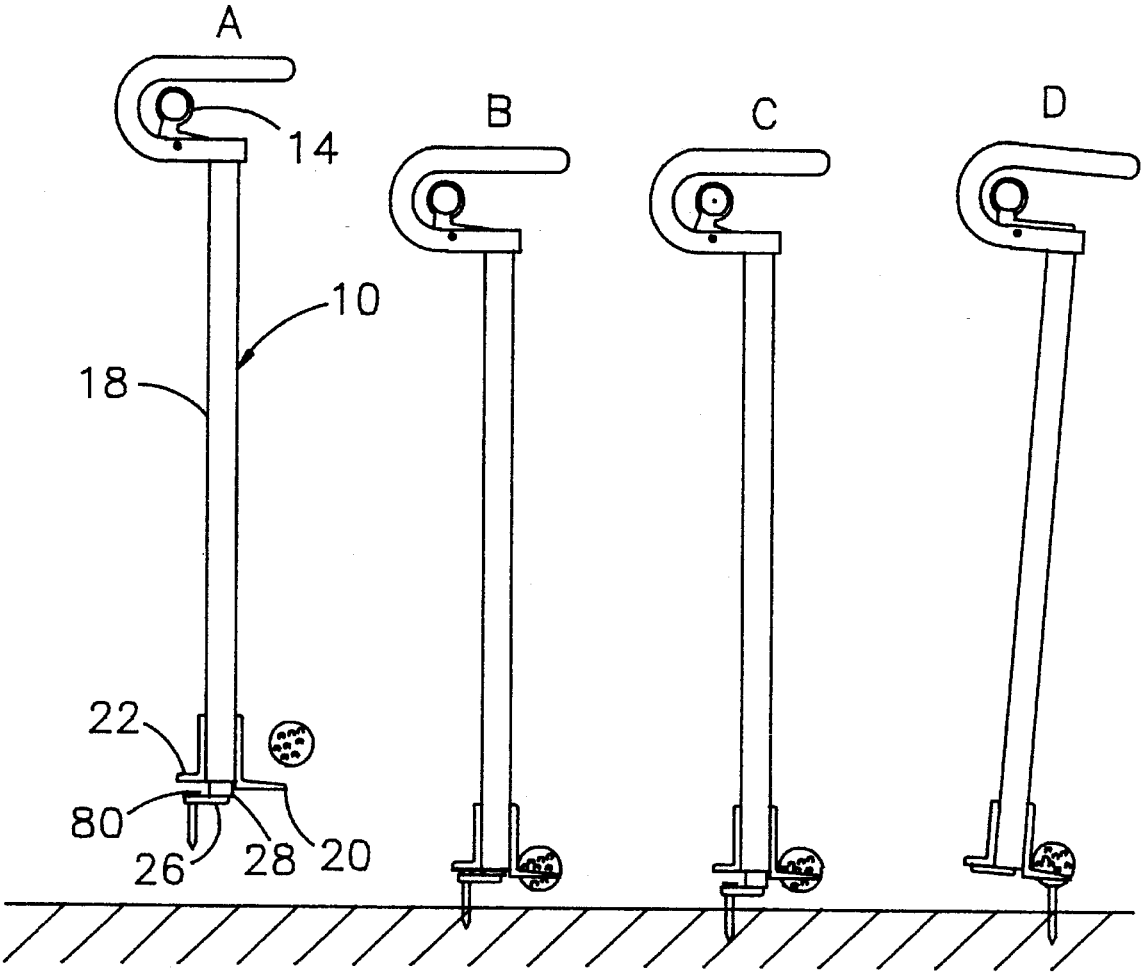
FIG. 10 is a plural view (A, B, C and D) showing sequentially the manner of the tee pick up, its implanting, device release and ball placement on the grounded tee.

The major steps in the manner of use of the present invention by an operator is depicted in the sequential views of FIG. 10. Firstly, the upper end of the device 10 is gripped, the handle cantilever 14 is deflected upwardly, to effect a lower end gap 80 between the flanges, for tee insertion (FIG. 10A). The lever tension is then released, clamping the tee (and the ball optionally) and the device is thrust into the turf for tee placement (FIG. 10B). After tee placement, the handle lever 14 is again deflected to declamp the tee, and lift the device away from the planted tee, and to effect ball mounting on the same planted tee (FIG. 10C & D). When the tee shot is made, device 10 can be used to remotely (non-stooping) recover the used tee (if it is to be found) and to permit its reuse on the next tee shot.

With this device both tee and ball placement are easily effected, but by neatly omitting the extreme stooping of the golfer, that is bane of certain golfers with lower back extension infirmities.

I claim:

1. A device for remote placement of a golf tee and a golf ball without need for golfer bending or squatting to effect a teed-up ball posture, comprising:

(a) an elongate tubular rigid shaft having lower and upper longitudinal ends of a length sufficient to bridge the vertical space existing between a depending human hand of a standing person and an underlying turf;

(b) an elongate rigid rod of a length somewhat greater than that of said shaft so as to project partly from the upper longitudinal end thereof and of a diameter of fitted within said shaft so as to move readily in sliding engagement therein;

(c) a manual gripping means having an outer and inner surface and joined at one longitudinal end proximal to the upper end of said tubular shaft and provided with a linear slot located along one intermediate lower segment of the inner surface of said gripping means proximal to said upper longitudinal end;

(d) an upstanding cantilevered member aligned operationally and pivotally within said linear slot, being provided with a finger engageable means and said rod also provided with a transverse pin at its outer end, the latter also disposed fixedly at proximal the upper end of said elongate rod;

(e) a compressible upwardly biasing means located within said segment anchored a at a position that is intermediate of the member inner end and of the pivotable axis of said cantilever member, which means is adapted to exert an upward tension on the periphery of the inner end of said cantilever member;

(f) spring biasing means mounted on said rod and operatively maintaining contact of said cantilever member outer end with the upper end of said elongate rod and also serving to activate the rod to move reciprocally along a linear path during an E arcuate path of motion of said cantilever member;

(g) a first right angle flange anchored along one peripheral section of the tubular shaft lower end and having a circular recess in its planar surface which is adapted to receive and rest a golf ball thereon via gravity until said ball is dislodged by manually contacting same;

(h) a second right angle flange anchored and disposed substantially diametrically opposite said first flange on the shaft lower end and providing an arrest function for limiting the degree of withdrawal of said elongate rod upwardly within said shaft; and (i) a third right angle flange located beneath and adjacent to said second flange having an inwardly opening recess at its outer end which is sized to support the shank of a golf tee and being anchored at its inner end to the lower longitudinal end of the elongate rod, with said second and third flanges being biased to rest in a releasable clamping relation with said second flange as provided by the upward bias on said rod;

whereby upon the manual rotation of the finger engageable means, causing separation of the normally clamped together second and third flanges, sequentially permitting manual insertion of a tee in said third flange recess, the reclamping of the inserted tee, the grounding of the tee, and the unclamping of a ground-fixed tee, all being done remotely without any torso bending.

2. A device as claimed in claim 1 wherein said manual gripping means is a generally U-shaped handle having said integral cantilever member aligned within said linear slot located on the lower inner surface of said gripping means.

3. A device as claimed in claim 1 wherein said compressible upwardly biasing means for said cantilever member is a coiled spring anchored at one longitudinal end thereof within said slot located on the lower inner surface opposing the cantilever member.

4. A device as claimed in claim 1 wherein said spring biasing means for said cantilever member outer end and said rod upper end comprises a being retained thereon by said fixed transverse pin coiled spring mounted on the elongate rod upper end and providing the upward linear bias on said cantilever outer end.

5. A device as claimed in claim 1 wherein said first flange is provided with an inner circular recess sized to less than the diameter of a golf ball.

6. A device as claimed in claim 1 wherein said second flange has a right angle configuration with the one outwardly projecting element thereof adapted to effect a rod-arrest function relative to said elongate rod during withdrawal.

7. A device as claimed in claim 1 in which said third flange has said inward recess presenting a slot of a transverse dimension less than that of a golf tee head.

8. A device as claimed in which the finger engageable means of said cantilever member is integral therewith and is located intermediate of the opposing longitudinal ends of said member.

9. A device as claimed in claim 1 in which said gripping means is also provided with an inwardly protruding bendable pin disposed within said upwardly biasing means and located proximal to the outer periphery of said cantilever member and is adapted to make continuous contact therewith, whereby said rod upper end is linearly responsive to any rotational motion of the cantilever member.

10. A device for remote placement of a golf tee and a golf ball without need for golfer bending or squatting to effect a teed-up ball posture comprising:

(a) an elongate tubular rigid shaft having lower and upper longitudinal ends of a length sufficient to bridge the vertical space existing between a depending human hand of a standing person and an underlying turf;

(b) an elongate rigid rod of a length somewhat greater than that of said shaft so as to project partly from the upper longitudinal end thereof and of a diameter fitted within said shaft so as to move readily in sliding co-axial engagement therein;

(c) a manual gripping means having an inner and outer surface and joined at one longitudinal end proximal to the upper end of said tubular shaft and provided with a linear slot located along one intermediate lower segment of the inner surface of said gripping means proximal to said upper longitudinal end;

(d) an upstanding cantilevered member aligned operationally and pivotally within said linear channel, being provided with a finger engageable means and also said rod provided with a transverse pin disposed fixedly at proximal the upper end of said elongate rod;

(e) a compressible upwardly biasing means located within said lower segment anchored at a position that is intermediate of the member inner end and of the pivotable axis of said cantilever member, which means is adapted to exert an upward tension on the periphery of the inner end of said cantilever member;

(f) spring biasing means mounted on said rod and operatively maintaining contact of said cantilever member outer end with the upper end of said elongate rod, and also serving to activate the rod to move reciprocally along linear path during any arcuate path of motion of said cantilever member;

(g) a first right angle flange anchored along one peripheral section of the tubular shaft lower end and having a circular recess in its planar surface which is configured to receive and retain a golf ball thereon via gravity until said ball is dislodged by manually contacting same;

(h) a second fight angled flange anchored and disposed substantially diametrically opposite said first flange on the shaft lower end and providing a rod-arrest function for limiting the degree of withdrawal of said elongate rod upwardly within said shaft;

(i) a third substantially rectangular flange located beneath and adjacent to said second flange having an inwardly opening recess at its outer end which is sized to engage and support the shank of a golf tee and being anchored at its inner end to the lower longitudinal end of the elongate rod, with said second and third flanges being normally biased to rest in a releasable clamping relation provided by the upward bias of said rod;

whereby upon the manual rotation of the finger engageable means effects longitudinal displacement of said second flange, causing separation of the normally clamped together second and third flanges, sequentially permitting manual insertion of a tee in said third flange recess, the reclamping of the inserted tee, the grounding of the tee, and the unclamping of a ground-fixed tee, all being done remotely without any torso bending.

* * * * *